US006027336A

United States Patent [19]

Nolte et al.

[11] Patent Number: 6,027,336

[45] Date of Patent: Feb. 22, 2000

[54] GAS BURNER FOR A HEATING FURNACE

[75] Inventors: Hubert Nolte; Roland Merker; Martin Herrs; Rolf Naumann, all of Höxter, Germany

[73] Assignee: Stiebel Eltron GmbH & Co. KG, Holzminden, Germany

[21] Appl. No.: 09/085,349

[22] Filed: May 27, 1998

[30] Foreign Application Priority Data

Jun. 12, 1997 [DE] Germany ..... 197 24 861

[51] Int. Cl.[7] ..... F23D 14/62

[52] U.S. Cl. ..... 431/354; 431/181; 431/350

[58] Field of Search ..... 431/354, 355, 431/346, 181, 182, 183, 350, 351, 353; 48/180.1; 126/39 R, 41 R, 110 R, 110

[56] References Cited

U.S. PATENT DOCUMENTS

| | | | |
|---|---|---|---|
| 1,466,356 | 8/1923 | Eddison | 431/354 |
| 1,853,863 | 4/1932 | Hornbruch | 48/180.1 |
| 4,907,964 | 3/1990 | Howarth | 431/202 |
| 5,240,411 | 8/1993 | Abalos | 431/354 |
| 5,762,490 | 6/1998 | Rodgers . | |
| 5,839,891 | 11/1998 | Cook | 431/354 |

FOREIGN PATENT DOCUMENTS

| | | |
|---|---|---|
| 2 481 415 | 4/1980 | France . |
| 39 02 025 A1 | 7/1989 | Germany . |
| 91 08 300 U | 11/1991 | Germany . |
| 92 05 202 | 7/1992 | Germany . |
| 41 15 814 A1 | 12/1992 | Germany . |
| 43 41 997 A1 | 6/1995 | Germany . |
| 44 33 425 A1 | 3/1996 | Germany . |
| 9100767 | 12/1992 | Netherlands . |

*Primary Examiner*—James C. Yeung
*Attorney, Agent, or Firm*—McGlew and Tuttle, P.C.

[57] ABSTRACT

A gas burner for a heating furnace with at least one burner pipe (1) with flame openings (7). An intake opening (5) is provided in which primary air enters and wherein burnable gas enters through a gas nozzle (4) penetrating into the intake opening (5). The percentage of primary air remains extensively unaffected during changes in the gas pressure occurring as a consequence of a change in the nature of the gas. The gas nozzle (4) has within the burner pipe (1) either only at least one gas opening (16), which is radial to the longitudinal axis (A) of the burner pipe (1), wherein the primary air can be fed to the burner pipe (1) via a blower (12), or—in the case of a design as an atmospheric gas burner—gas openings (16), which are radial to the longitudinal axis (A) of the burner pipe (1), as well as a displaceable nozzle part (21), which forms a gas opening (23) which is axial to the longitudinal axis (A) of the burner pipe (1) and opens the radial gas openings (16) during increasing gas pressure and closes them at low gas pressure.

14 Claims, 2 Drawing Sheets

GAS BURNER FOR A HEATING FURNACE

FIELD OF THE INVENTION

The present invention pertains to a gas burner for a heating furnace with at least one burner pipe with flame opening and with an opening for the intake of primary air and burnable gas, a gas nozzle penetrating into the opening.

BACKGROUND OF THE INVENTION

Such a gas burner has been known from DE 92 05 202 U1. In this atmospheric burner, the gas nozzle extends into the opening of the burner pipe, so that air (primary air) is drawn in by the gas flowing into the burner pipe due to a reduced injector effect. The air volume flow drawn in depends on the mass flow of the gas. This dependence is not desirable in all gas burners.

A gas burner with an injector associated with a burner pipe has been known from DE 43 41 997 A1. A gas nozzle, which has a main nozzle hole and at least one secondary nozzle hole, which are directed at an angle to the axis of the injector, is associated with the injector. A closing element, which can be moved between an open position and a closed position, is associated with the main nozzle hole, so that operation with reduced amount of gas is possible at unchanged gas pressure via the sloped secondary nozzle hole with reduced percentage of primary air.

A control device for a gas burner is described in DE 44 33 425 A1. A control circuit controls the speed of rotation of an air-delivering blower as a function of the combustion. The design of the burner is not described more specifically.

SUMMARY AND OBJECTS OF THE INVENTION

The primary object of the present invention is to provide a gas burner of this type, at the gas nozzle of which the percentage of primary air remains practically unaffected during changes in the gas pressure occurring as a consequence of a change in the nature of the gas.

According to the invention, a gas burner for a heating furnace is provided with at least one burner pipe with flame openings and an intake opening. Primary air enters and burnable gas enters through the intake opening. A gas nozzle is provided penetrating into the opening within the burner pipe. The gas nozzle has only at least one gas opening which is radial to the longitudinal axis of the burner pipe to form a non-injector supply means. The primary air can be fed to the burner pipe via a blower.

The intake opening of the burner pipe preferably tapers conically in the downstream direction. The radial gas openings are preferably distributed on the circumference and are located close to or in the direction of flow beyond an end of the conical taper of the opening.

In the case of a design as an atmospheric gas burner, the gas nozzle has gas openings which are radial to the longitudinal axis (A) of the said burner pipe within the burner pipe, as well as a displaceable nozzle part, which forms a gas opening, which is axial to the longitudinal axis (A) of the burner pipe and opens the radial gas openings during increasing gas pressure and closes them during low gas pressure.

The gas flowing into the burner pipe through the radial gas openings radially to the longitudinal axis of the burner pipe exerts practically no injector effect, and the amount of primary air is determined essentially by the blower according to the invention. Lifting off of the flame from the burner as a consequence of increased injector effect and the tendency of the burner to produce an excessively large amount of CO can thus be avoided. This lifting off of the flame from the burner may be so extreme that the flame will go out, as a consequence of which the furnace would be shut off on an emergency basis.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 2:
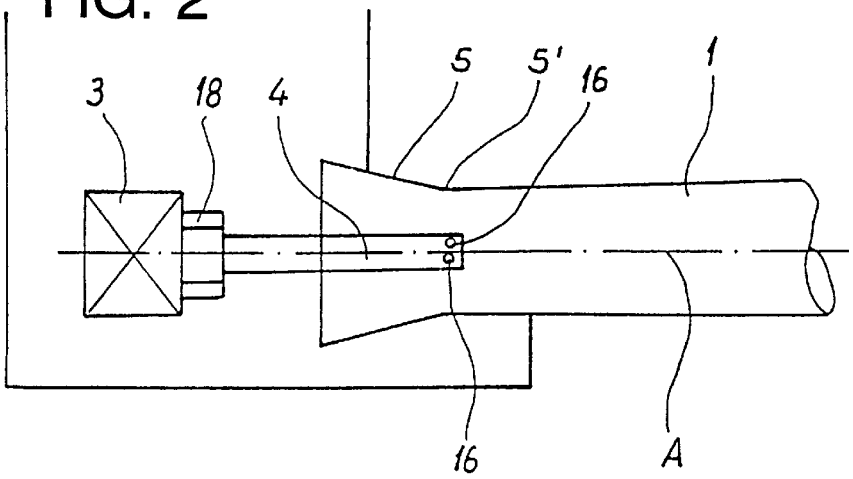
FIG. 2 is a partially schematic view of a gas nozzle in a burner pipe of the gas burner according to FIG. 1.
Figure 5:
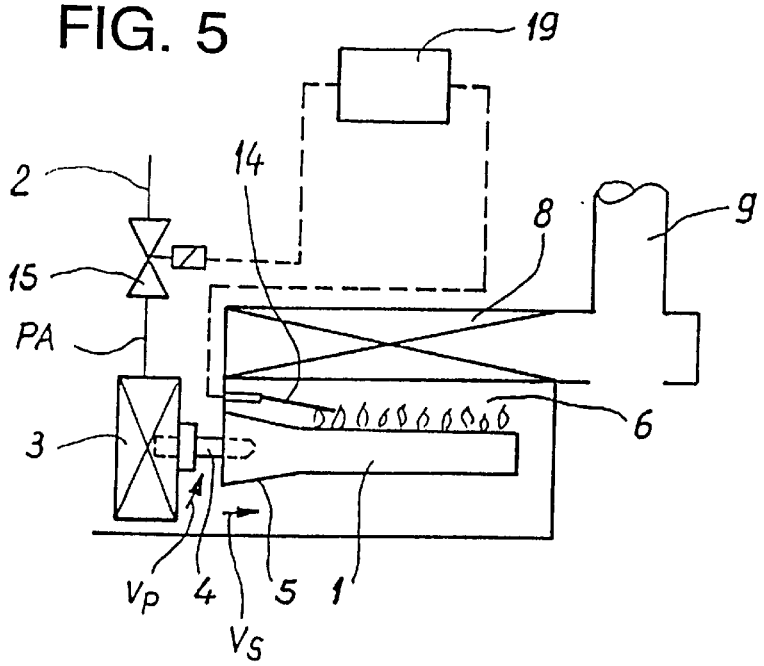
FIG. 5 is a gas burner with gas-controlled atmospheric combustion.
Figure 6:
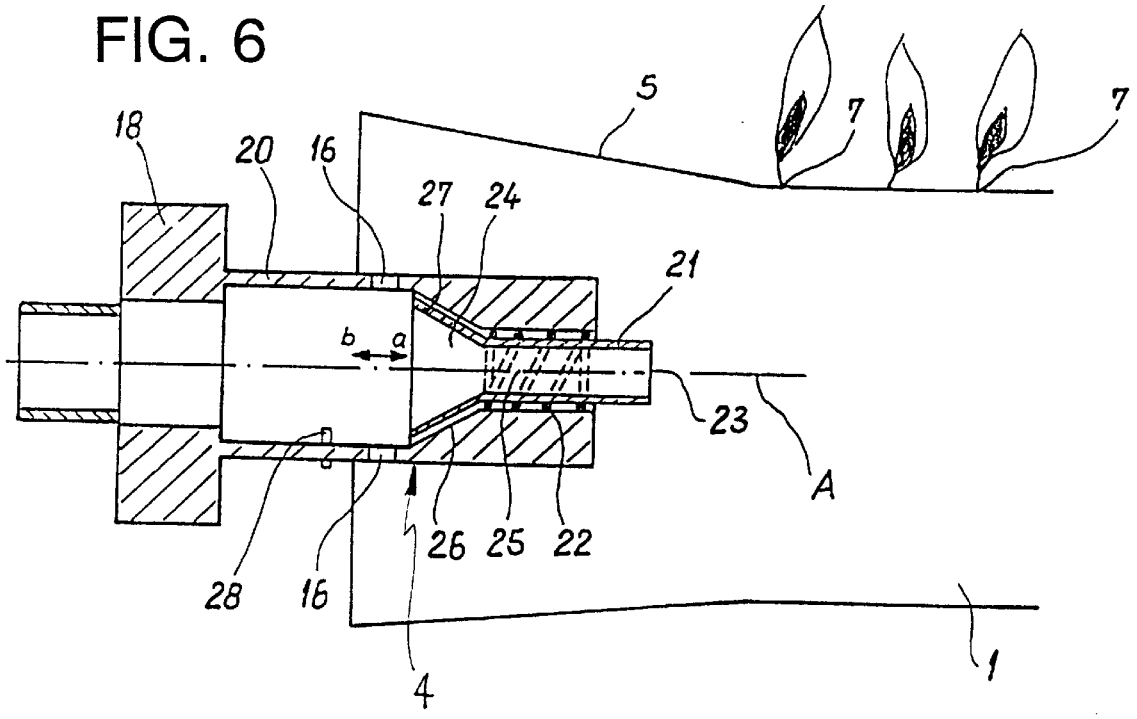
FIG. 6 is a gas nozzle in a burner pipe of the gas burner according to FIG. 5.

Referring to the drawings in particular, a gas burner with a plurality of burner pipes 1, of which only one is shown in FIGS. 2, 5 and 6, carries gas nozzles 4 at a gas distributor 3 connected to a gas line 2. The burner pipe 1 with the longitudinal axis A has an opening 5 tapering conically in the downstream direction and flame openings 7 in a combustion chamber 6. A heat exchanger 8 is arranged in the combustion chamber 6. The combustion chamber 6 is connected to a flue gas pipe 9. Primary air Vp flows into the burner pipe 1 via the opening 5. Secondary air Vs can enter into the combustion chamber 6 due to the thermal uplift occurring in the combustion chamber 6 (see FIG. 5).

Figure 1:
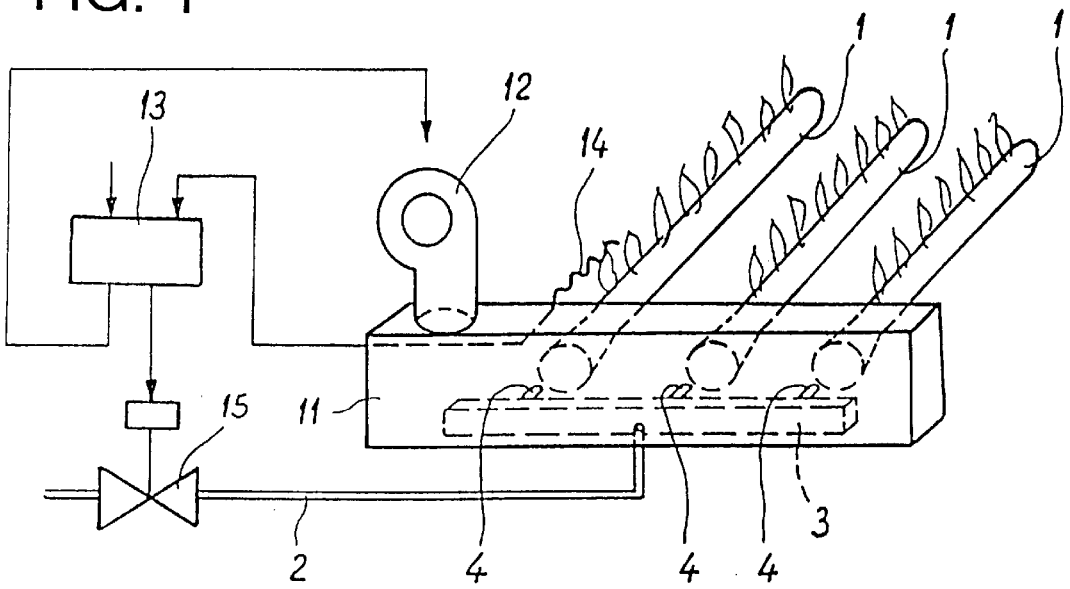
FIG. 1 is a partially schematic view of a gas burner with blower-supported combustion according to the invention.

In the exemplary embodiment according to FIG. 1, a burner with blowersupported combustion is provided. A blower 12, whose speed of rotation can be controlled by a control circuit 13 as a function of the outside temperature, the amount of heat required, and/or a heating characteristic, is located at an air receiver 11, to which the openings 5 of the burner pipes 1 are connected. An ionization electrode 14 arranged in the area of the flame detects the combustion temperature that corresponds to the air ratio (lambda) of the particular gas-air mixture. The control circuit derives a deviation from the air ratio and an air ratio set point and controls a gas valve 15 located in the gas line 2 with a corresponding correcting variable in a modulating manner. A deviation is generated in the case of a change in the speed of rotation of the blower or of a change in the nature of the gas. The control circuit 13 shall adjust the amount of burnable gas needed to reach the air ratio set point to the amount of air, which is controlled as a function of the amount of heat needed.

Figure 3:
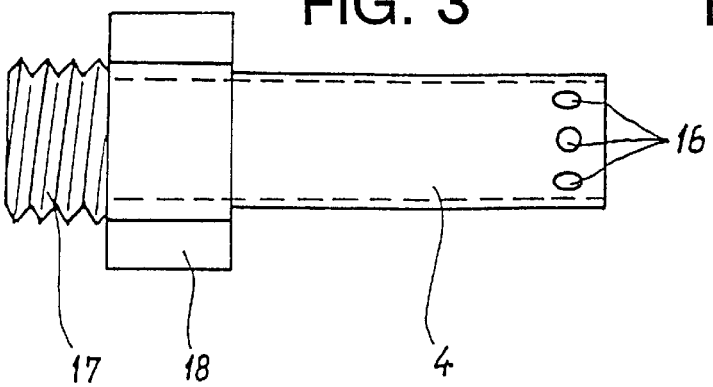
FIG. 3 is an enlarged side view of the gas nozzle according to FIG. 2.
Figure 4:
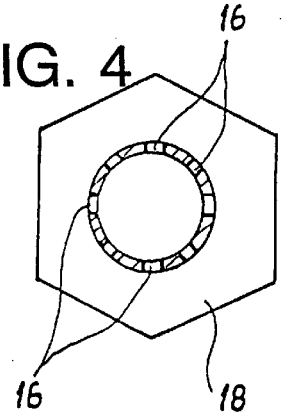
FIG. 4 is a cross sectional view of the gas nozzle according to FIG. 3.

To ensure the reliable operation of the control circuit, an unambiguous assignment of the burner output to the particular blower speed must be ensured. The gas nozzle 4 (see FIGS. 2 through 4) is therefore arranged such that it penetrates into the burner pipe 1 coaxially to the longitudinal axis A, doing so to a point just beyond the end 5' of the conical taper of the opening 5. The gas nozzle 4 has a plurality of gas openings 16 distributed on its circumference, i.e., radially to the longitudinal axis A. These openings 16 are located in the burner pipe 1 farther inwardly (farther to the right in FIG. 2) than the inner end 5' of the opening 5. The gas nozzle 4 has no gas opening in the direction axial to the longitudinal axis A such that the radial openings 16 form a non-injector supply means. The gas nozzle 4 can be screwed into the gas distributor 3 at an external thread 17 by means of a hexagon projection 18.

The gas entering the burner pipe 1 through the gas openings 16 is extensively prevented from exerting an air-drawing injector effect due to the arrangement of the gas nozzle 4 and the location of the gas openings 16. It is thus guaranteed that the amount of air fed into the burner pipe 1 depends predominantly only on the speed of rotation of the blower 12 rather than on the gas pressure prevailing in the gas nozzle 4 or the particular gas volume flow.

A gas-controlled atmospheric burner is provided in the exemplary embodiment according to FIGS. 5 and 6. This gas-controlled atmospheric burner operates without a blower.

If highly premixing burner pipes are used, the ratio of primary air Vp to secondary air Vs is >1 in the case of atmospheric burners. Consequently, more primary air is drawn in than the amount of secondary air entering for the combustion. The flame length decreases due to the increase in the percentage of primary air. This is favorable because the thermal NOx formation is reduced as a result. However, such highly premixing burner pipes have the drawback of being sensitive to changes in the nature of the gas and in the draft conditions. To be able to operate with high-calorie gas, e.g., natural gas H, or with low-calorie gas, e.g., natural gas L, the gas nozzle 4 shown in FIG. 6 is used in the gas burner according to FIG. 5.

The gas burner operates with a controller 19, to which the ionization electrode 14 detecting the combustion is connected. The controller 19 controls the gas valve 15, e.g., a solenoid valve, and thus the gas pressure PA prevailing at the gas nozzle 4 corresponding to the combustion. It sets a higher pressure in the case of low-calorie natural gas L than in the case of high-calorie natural gas H.

The gas nozzle 4 (see FIG. 6) has a jacket body 20 and an inner nozzle part 21 displaceable in the jacket body 20. The nozzle part 21 is mounted displaceably in the longitudinal direction A in the jacket body 20 and is loaded by means of a compression spring 22 against the direction of gas flow a, namely, in direction b. A gas opening 23 located coaxially to the longitudinal direction A is provided at the nozzle part 21. Inside the jacket body 20, the nozzle part 21 has a conical expansion 24, which tapers into a tubular gas channel 25 forming the gas opening 23. The jacket body 20 forms a stop with a constricted part 26 for the movement of the nozzle part 21 in the direction a, against the direction b.

The gas openings 16, which are radial to the longitudinal axis A, are provided on the jacket body 20 and form the non-injector supply means. They are located within the conical opening 5 of the burner pipe 1. The expansion 24 of the nozzle part 21 forms an edge 27, which closes off the gas openings 16 when the nozzle part 21 has been displaced by the compression spring 22 in the direction b against a stop 28.

The mode of operation of the gas nozzle according to FIG. 6 is approximately as follows:

At low gas pressure PA, the compression spring 22 presses the nozzle part 21 against the stop 28, so that the radial gas openings 16 are closed and gas can enter into the burner pipe 1 through the axial gas opening 23 only. This gas flow leads to an injector effect, by means of which primary air Vp is drawn into the burner pipe 1. The nozzle part 21 is displaced in direction a by an increasing gas pressure PA, and the radial gas openings 16 become free, and gas will now enter the burner pipe 1 through these as well. This amount of gas generates essentially no injector effect, so that the volume of primary air drawn in does not practically increase.

On the whole, favorable combustion values are consequently reached regardless of the type of gas, because the gas nozzle 4 according to FIG. 6 adjusts itself.

While specific embodiments of the invention have been shown and described in detail to illustrate the application of the principles of the invention, it will be understood that the invention may be embodied otherwise without departing from such principles.

What is claimed is:

1. A gas burner for a heating furnace, the gas burner comprising:

at least one burner pipe with flame openings and an intake opening through which primary air enters, said intake opening of said burner pipe tapers conically in a downstream direction to a conical taper end; and a gas nozzle penetrating into said intake opening, burnable gas entering into said burner pipe through said gas nozzle, said gas nozzle within said burner pipe having non-injector supply means for supply of said burnable gas including a plurality of gas openings which are radial with respect to a longitudinal axis of said burner pipe, said non-injector means supplying said burnable gas only radially when primary air is fed to said burner pipe via a blower, said gas openings being distributed on a circumference of said gas nozzle located close to or in a direction of flow beyond said conical taper end.

2. The burner in accordance with claim 1, wherein:

said plurality of radial gas openings are located downstream of said conical taper end.

3. The burner in accordance with claim 1, wherein:

said plurality of radial gas openings are arranged adjacent said conical taper end.

4. The burner in accordance with claim 2, wherein:

said plurality of radial gas openings are arranged adjacent said conical taper end.

5. A gas burner for a heating furnace, the gas burner comprising:

at least one burner pipe with flame openings and an intake opening through which primary air enters, said intake opening of said burner pipe tapers conically in a downstream direction from an intake end to a conical taper end;

a gas nozzle penetrating into said intake opening, burnable gas entering into said burner pipe through said gas nozzle; and non-injector supply means associated with said gas nozzle within said burner pipe for supply of said burnable gas including a plurality of radial gas opening which direct gas radially with respect to a longitudinal axis of said burner pipe, said plurality of radial gas openings are distributed on a circumference of said gas nozzle located close to or in a direction of flow beyond said conical taper end.

6. A gas burner in accordance with claim 5, further comprising a blower for feeding primary air to said burner pipe, said non-injector means supplying said burnable gas only radially when primary air is fed to said burner pipe via said blower.

7. The burner in accordance with claim 5, wherein:

said plurality of radial gas openings are located downstream of said conical taper end.

8. The burner in accordance with claim 5, wherein:

said plurality of radial gas openings are arranged adjacent said conical taper end.

9. The burner in accordance with claim 7, wherein:

said plurality of radial gas openings are arranged adjacent said conical taper end.

10. The burner in accordance with claim 5, further comprising:

a blower for feeding primary air to said burner pipe through said cone of said intake opening and radially around said gas nozzle.

11. A gas burner for a heating furnace, the gas burner comprising:

a burner pipe with flame openings and an intake opening through which primary air enters, said intake opening including a cone conically tapering in a downstream direction of said burner pipe;

a gas nozzle penetrating into said intake opening, burnable gas entering into said burner pipe through said gas nozzle, said gas nozzle defining a plurality of radial gas openings which direct the gas radially with respect to a longitudinal axis of said burner pipe, said plurality of radial gas openings are distributed on a circumference of said gas nozzle and are located downstream of said cone of said intake opening.

12. The burner in accordance with claim 11, wherein:

said plurality of radial gas openings are arranged adjacent said cone of said intake opening.

13. The burner in accordance with claim 11, further comprising:

a blower for feeding primary air to said burner pipe through said cone of said intake opening and radially around said gas nozzle.

14. The burner in accordance with claim 12, further comprising:

a blower for feeding primary air to said burner pipe through said cone of said intake opening and radially around said gas nozzle.

* * * * *